US009844967B1

(12) United States Patent
Orr

(10) Patent No.: US 9,844,967 B1
(45) Date of Patent: Dec. 19, 2017

(54) DAILY DEVOTIONAL DESSERT CALENDAR

(71) Applicant: Tina Faith Orr, Kathleen, GA (US)

(72) Inventor: Tina Faith Orr, Kathleen, GA (US)

(73) Assignee: Tina Faith Orr, Kathleen, GA (US)

( * ) Notice: Subject to any disclaimer, the term of this patent is extended or adjusted under 35 U.S.C. 154(b) by 0 days.

(21) Appl. No.: 15/284,418

(22) Filed: Oct. 3, 2016

Related U.S. Application Data

(60) Provisional application No. 62/269,727, filed on Dec. 18, 2015.

(51) Int. Cl.
*G09D 3/00* (2006.01)
*B42D 5/04* (2006.01)

(52) U.S. Cl.
CPC ..... *B42D 5/047* (2013.01); *G09D 3/00* (2013.01)

(58) Field of Classification Search
CPC ... G09D 3/00; G09D 3/04; G09D 3/02; G09F 3/02
See application file for complete search history.

(56) References Cited

U.S. PATENT DOCUMENTS 1,200,348 A * 10/1916 Hawk ..... G09D 3/02 40/107
1,568,729 A * 1/1926 Gearon ..... A47B 49/00 135/90
3,225,913 A * 12/1965 Lee ..... B65D 83/0445 206/232
3,594,923 A * 7/1971 Midgley ..... G09B 23/24 434/298
6,186,553 B1 * 2/2001 Phillips ..... B42D 5/04 283/2
6,223,912 B1 * 5/2001 Nerushai ..... A47F 1/12 206/459.5
D460,254 S * 7/2002 Rufo ..... D3/203.3
6,550,165 B2 4/2003 Chirafesi
7,690,690 B1 * 4/2010 Campbell ..... G04G 9/00 283/2
7,913,434 B1 3/2011 Olaver
D660,583 S * 5/2012 Mlinarevic ..... D3/203.3
D732,110 S 6/2015 Lau et al.
(Continued)

FOREIGN PATENT DOCUMENTS

GB 2122793 1/1984

OTHER PUBLICATIONS

Discovery House, Our Daily Bread Perpetual Calendar, 2012, http://www.christianbook.com/our-daily-bread-perpetual-calendar/9781572935457/pd/935457?event=Gifts|1004021.
(Continued)

*Primary Examiner* — Cassandra H Davis

(57) ABSTRACT

A Customized Storage Calendar including a backboard, calendar frame, partitions, configured as six rows and seven columns, to define forty-two storage compartments, thirty-one day boxes displaying the day number and positive subject area which are refillable, month box displaying the current month slider which also provides storage for non-current month sliders, horizontal support member, and a week face plate. The reusable Customized Storage Calendar configured as a devotional calendar allows for the creation of a new tradition by establishing a post-dinner ritual by displaying a daily spiritual religious devotional to be read which proceeds with a portion controlled dessert.

1 Claim, 8 Drawing Sheets

(56) References Cited

U.S. PATENT DOCUMENTS

| | | | | |
|---|---|---|---|---|
| 2001/0036127 | A1* | 11/2001 | McCravy | B42D 5/042 368/28 |
| 2003/0163936 | A1 | 9/2003 | Floss | |
| 2009/0007467 | A1* | 1/2009 | Bowman | G09D 3/04 40/107 |
| 2010/0206765 | A1* | 8/2010 | Fonte | A61J 7/04 206/534 |
| 2013/0195326 | A1* | 8/2013 | Bear | A61J 7/0076 382/128 |
| 2015/0108035 | A1* | 4/2015 | Delforte | B42D 5/047 206/562 |

OTHER PUBLICATIONS

Andrews McMeel Publishing, Bible Verse-a-Day Mini Desk Calendar, 2016, http://www.calendars.com.
http://www.calendars.com/Bible-Verse-a-Day-Mini-Desk-Calendar/prod201500002157/?categoryId=cat440048&edition=2016&gclid=CPH0zNum-80CFQyNaQodkXwAwg.

* cited by examiner

32

DAILY DEVOTIONAL DESSERT CALENDAR

BACKGROUND OF THE INVENTION

Field of the Invention

The present invention relates to calendars. More specifically, this invention is a reusable Customized Storage Calendar which can be configured as a devotional calendar.

Description of the Related Art

There are many calendars available in various formats including paper, electronic, computer generated, and others. Advent calendars observe religious celebrations only during the Christmas year 25 days and typically offering one chocolate per countdown day which allows for only one person to enjoy the chocolate. Tear off paper calendars are not reusable. Currently, available calendars on the market cannot be customized to accommodate a variety of desserts such as wrapped chocolates, mints, and candies.

BRIEF SUMMARY OF THE INVENTION

Disclosed herein is a reusable Customizable Storage Calendar consisting of a backboard, month box, week face plate, horizontal support member, a calendar frame comprising a top wall, bottom wall, left wall, and right wall for supporting the inner compartments, formed by horizontal partitions and vertical partitions, which hold the day boxes. The month box, containing twelve month sliders, is removably mounted on the top wall of the calendar frame. The week face plate is sandwiched between the top wall of the calendar frame and the horizontal support member.

Traditional rituals include people giving thanks and blessing prayers prior to the main meal. This invention is shown customized as a devotional calendar, allowing for the creation of a post-dinner ritual for a daily spiritual, religious devotional to be read prior to dessert, thus establishing a new family tradition.

BRIEF DESCRIPTION OF THE DRAWINGS

Views

REFERENCE NUMERALS IN THE DRAWINGS

Reference Numerals

10 Day Boxes
12 Week Face Plate
14 Month Box
16 Current Month Slider
18 Top Wall
20 Horizontal Support Member
22 Bottom Wall
24 Non-Current Month Sliders
26 Left Wall
28 Right Wall
30 Vertical Partitions
32 Horizontal Partitions
34 Backboard

DETAILED DESCRIPTION OF THE INVENTION

Figure 1:
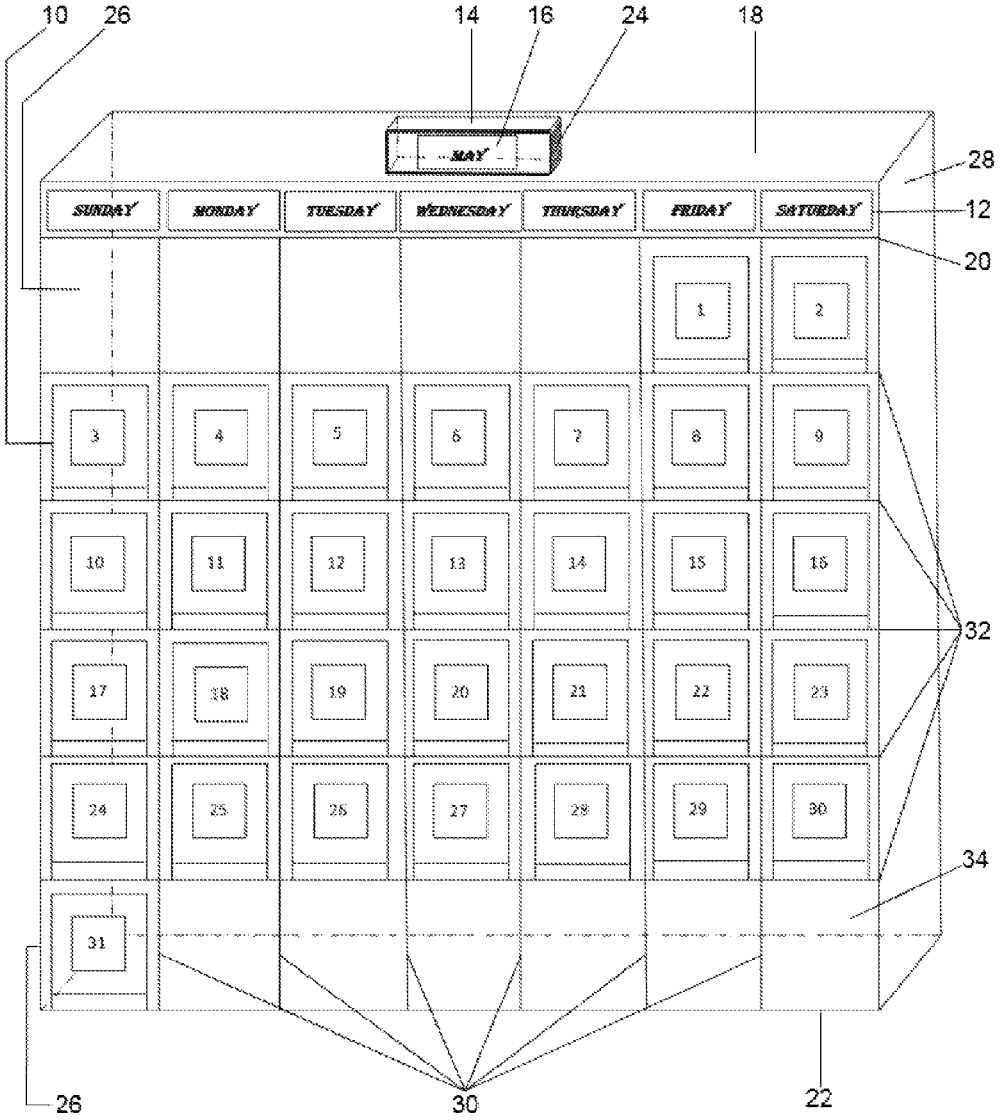
FIG. 1 is a perspective view of the Customized Storage Calendar configured as a devotional calendar.

FIG. 1 shows a perspective view of the Customized Storage Calendar in the fully assembled state. The Customized Storage Calendar comprises a backboard 34, top wall 18, bottom wall 22, left wall 26, right wall 28 for supporting the five horizontal partitions 32 and six vertical partitions 30. The five horizontal partitions and six vertical partitions define forty-two compartments, configured as 6 rows and 7 columns, which hold the thirty-one day boxes 10. Each day box has a number displayed on the front wall corresponding to the day, along with information that can be customized to any positive subject area displayed on the top wall of each box. The Customized Storage Calendar also comprises a horizontal support member 20 for supporting the week face plate 12 which displays seven days of the week, and a month box 14 which holds the twelve month sliders 16, 24. The Customized Storage Calendar also has 6 rows which adequately displays all days of the month. In the year 2017, the months of April, July, and December require 6 rows to adequately display all days. In the year 2018, the months of September and December require 6 rows to adequately display all days. Many calendars contain only 5 rows which does not adequately display all days of some months.

Seven days of the week are displayed on the week face plate 12 below the month box 14. The week face plate is sandwiched between the top wall 18 of the calendar frame and the horizontal support member 20.

The month box 14 is removable mounted on the top wall 18 of the calendar frame above the week face plate 12. The current month slider 16 easily slides out of the month box 14 for swapping out the month. The non-current month sliders 24 easily slide behind the current month slider 16 and are stored in the hollow interior storage area of the month box 14.

Customized Storage Calendars composed of wood material should be wall mounted on studs. Customized Storage Calendars composed of paper or cardboard material are tabletop and can be supported by a backing if necessary. The Customized Storage Calendar can be glued and/or folded and jointed depending on the material. The material choice for the calendar is durable, cuttable material that is capable of receiving indicia to display the months, days of the week, numeric day of the month (1-31), and positive subject matter. As used herein, the term "indicia" refers to a depiction including printed, numerical, artistic, customized, religious, or educational matter, and also including indications of calendar information such as month, day number, and day of week. Indicia displayed on the calendar can be printed, lasered, engraved, or screen printed onto material such as wood, cardboard, or other suitable material.

Figure 2:
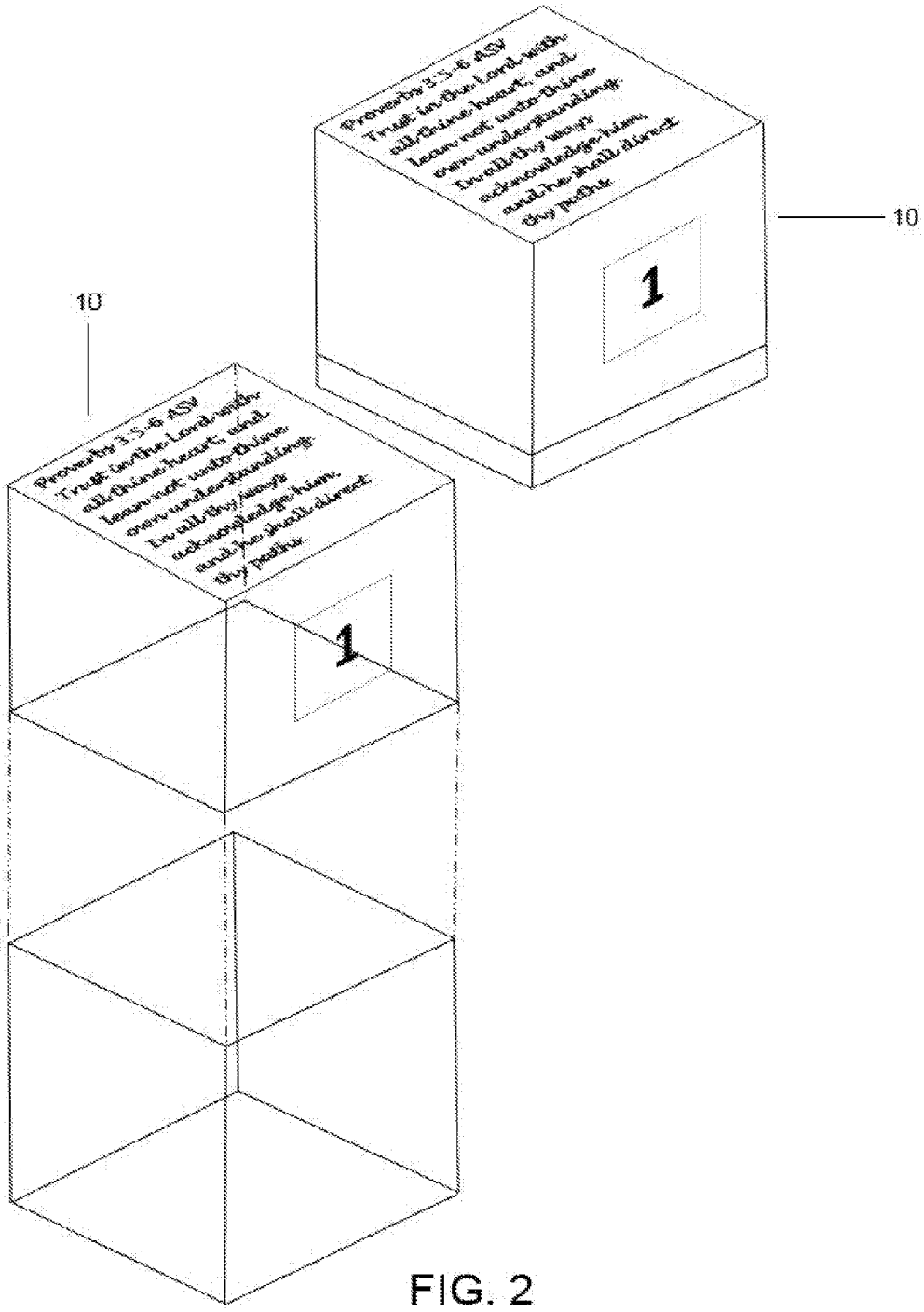
FIG. 2 is an exploded perspective view of the day box configured for Day 1.

FIG. 2 shows an exploded perspective view of the day box 10 for Day 1 of the Customized Storage Calendar invention configured as a devotional calendar when closed and then opened. The thirty-one numbered day boxes have a front wall, back wall, side walls, top wall, and bottom wall that define a day box storage area. A day number is displayed on the front wall of the box. The top wall of the day box can be customized to display any positive subject matter. The top wall of the day box displays a biblical devotional verse when configured as a devotional calendar. When configured as a devotional calendar, the day boxes can be opened to insert various types of wrapped chocolates or candies and are made of wood, cardboard, or other durable material which display a verse for a daily spiritual devotional ritual and provide a means for portion controlled dessert. Portion controlled desserts are items such as off the shelf wrapped chocolates and wrapped mints. The fully assembled state of the day box is a closed box with the display of information on the top wall of the box.

The numbered day boxes 10 can be rotated once the current day passes resulting in a clearer visualization of the present day. Likewise, for months with less than thirty-one days, the unused days can be rotated displaying the back wall of the box or removed from the calendar.

When configured as a devotional calendar, each day box has a day number displayed on the front wall and a unique biblical devotion verse on the top wall of each box. Additional verses can be added by utilizing the space opposite side of the top wall or any suitable display area of the day box. The devotional information displayed on the top wall of each box can be customized to display any positive subject area. For example, the boxes can be customized to display at least religious, inspirational, motivational, educational, task information and related insignia and this disclosure anticipates all of these options.

Calendar days is defined as all days in a month, including weekends and holidays. The notion of a holiday was frequently derived in association with religious observances allowing individuals to fulfill spiritual obligations on notable, honored calendar dates. Holidays have progressed over time and in many cultures they are a means to explore leisure and recreational activities. The Customized Storage Calendar can also comprise holiday boxes (New Year's Day, Valentine's Day, Happy Birthday, St. Patrick's Day, Easter, Mother's Day, Memorial Day, Father's Day, 4th of July, Columbus Day, Halloween, Veteran's Day, Thanksgiving, Christmas, etc.) as the definition of calendar days encompasses holidays and this disclosure anticipates this option. For example, the day box for day "25" would be removed from the calendar and replaced with the Christmas box for the corresponding day position in the month of December.

Figure 3:
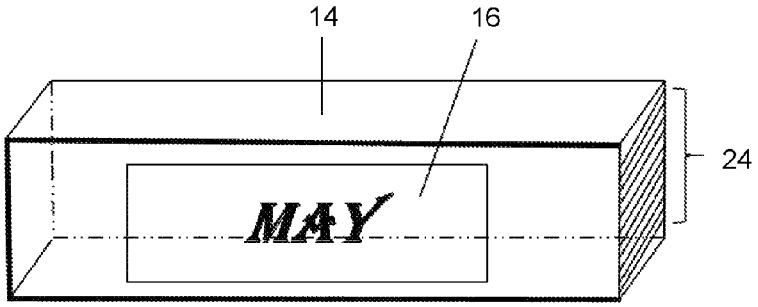
FIG. 3 is an exploded perspective view of the Calendar Month Box.

FIG. 3 shows an exploded perspective view of the month box 14. The month box 14 displays the current month slider 16 and stores the remainder non-current month sliders 24 in the hollow interior area of the month box. The month box 14 allows for the months to be easily swapped to display the current month, which easily slides out to change the month to be displayed. The month box is made of durable, cuttable material comprising a top wall, bottom wall, back wall, and a left side wall, that define a hollow interior box storage area and a front slot displayed in FIG. 14B.

Figure 4:
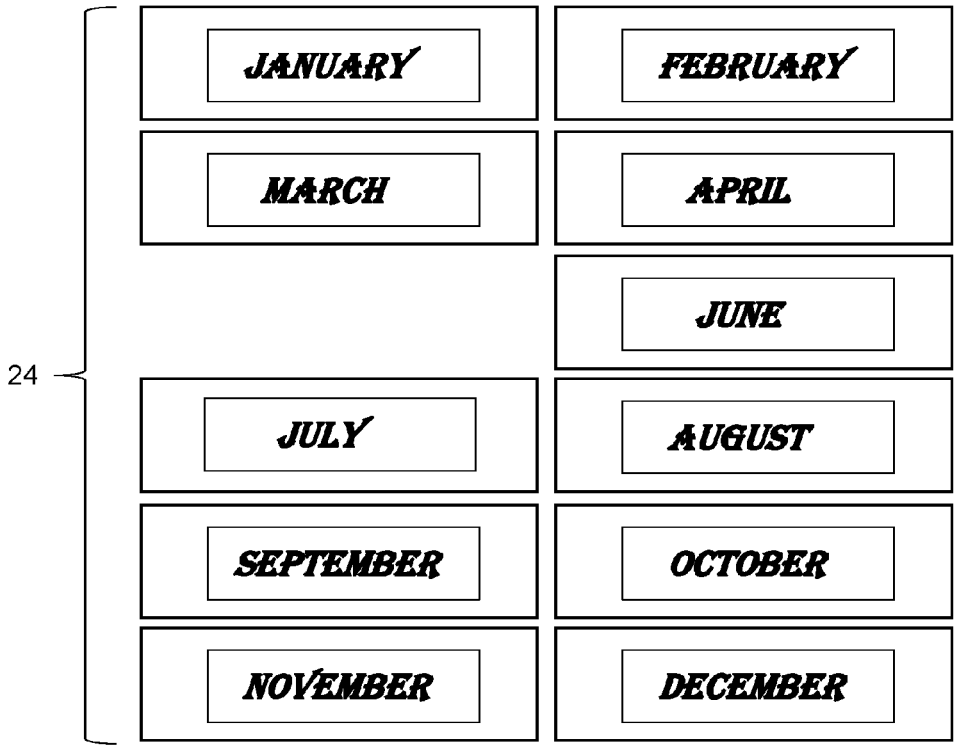
FIG. 4 is a front view of the Calendar's Non-Current Month Sliders.

FIG. 4 shows the front view of the calendar's non-current month sliders 24 when removed from the month box 14. The non-current month sliders are of wood, cardboard, or other material.

Figure 5:
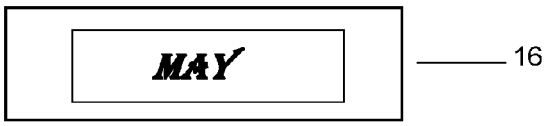
FIG. 5 is a front view of the Calendar's Current Month Slider.

FIG. 5 shows the front view of the calendar's current month slider 16 displaying the month of May as an example.

Figures 6, 7, 8, 9, 10, 11, 12:
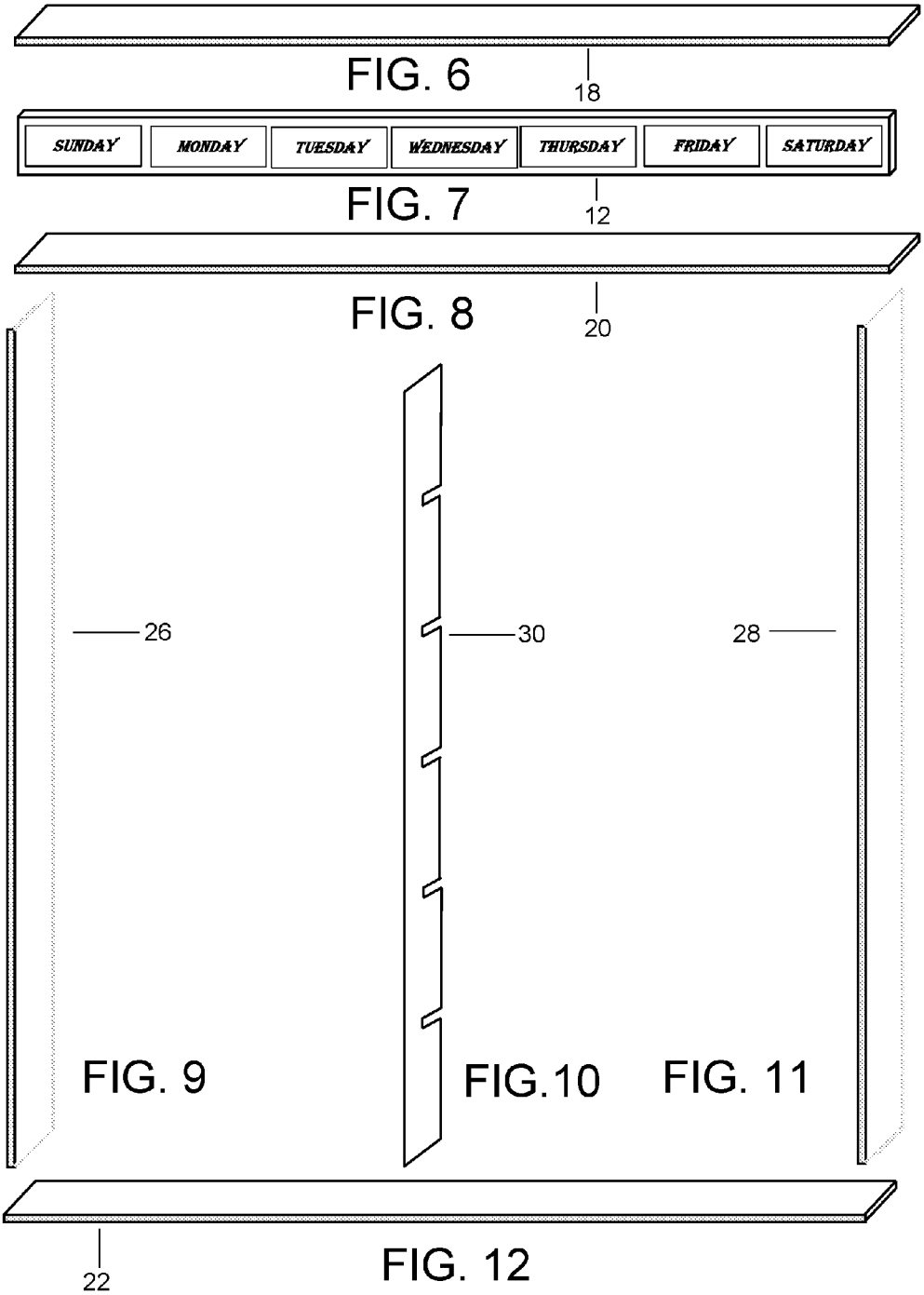
FIG. 6 is a perspective view of the Top Wall.
FIG. 7 is a perspective view of the Week Face Plate.
FIG. 8 is a perspective view of the Horizontal Support Member.
FIG. 9 is a perspective view of the Left Wall.
FIG. 10 is a perspective view of the Vertical Partitions (Quantity=6).
FIG. 11 is a perspective view of the Right Wall.
FIG. 12 is a perspective view of the Bottom Wall.

FIG. 6 shows a perspective view of the Top Wall 18.

FIG. 7 shows a perspective view of the Week Face Plate 12 which is also made of wood, cardboard, or other material. The Week Face Plate 12 is sandwiched between the Top Wall 18 and the Horizontal Support Member 20.

FIG. 8 shows a perspective view of the Horizontal Support Member 20 which is positioned on top of the Vertical Partitions 30.

FIG. 9 shows a perspective view of the Left Wall 26 which is positioned to the left of the Horizontal Partitions 32, the Horizontal Support Member 20, Week Face Plate 12, and Top Wall 18.

FIG. 10 shows a perspective view of the Vertical Partitions 30. There is a total of six vertical partitions.

FIG. 11 shows a perspective view of the Right Wall 28 which is positioned to the right of the Horizontal Partitions 32, the Horizontal Support Member 20, Week Face Plate 12, and Top Wall 18.

FIG. 12 shows a perspective view of Bottom Wall 22 which is positioned below the Left Wall 26, Vertical Partitions 30, Horizontal Partitions 32, and Right Wall 28.

Figure 13:
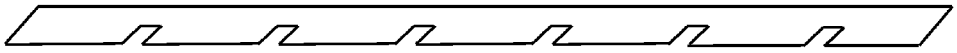
FIG. 13 is a perspective view of the Horizontal Partitions (Quantity=5).

FIG. 13 shows a perspective view of the Horizontal Partitions 32. There is a total of five horizontal partitions.

Figures 14A, 14B, 14C:
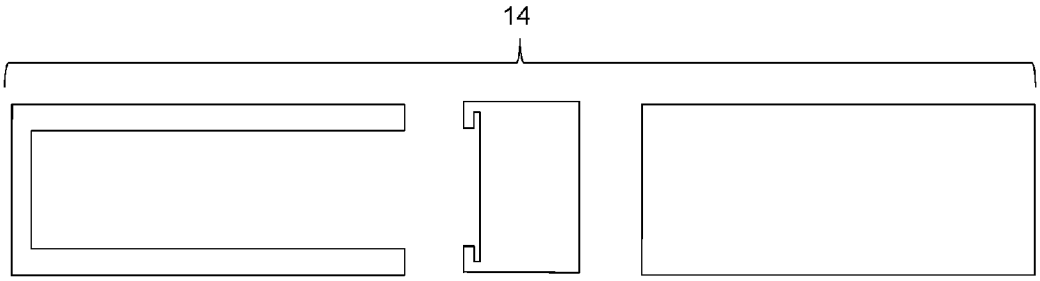
FIG. 14A is the front view of the Calendar Month Box without any month sliders inserted.
FIG. 14B is the side right view of the Calendar Month Box without any month sliders inserted.
FIG. 14C is the top, bottom, and back side view of the Calendar Month Box without any month sliders inserted.

FIG. 14A is the front view of the Month Box 14 without any month sliders inserted. FIG. 14B is the right side view of the Month Box 14 displaying the front slot without any month slider inserted. FIG. 14C is the top, bottom, and backside view of the Month Box 14 without any month sliders inserted.

Figure 14D:
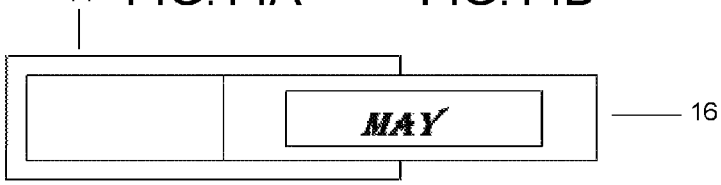
FIG. 14D is the front view of the Calendar Month Box, with remainder of the month sliders removed from the interior box storage area, displaying the month of May to illustrate the sliding action of the current month slider being inserted.
Figure 14E:
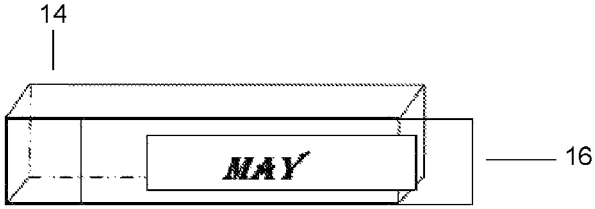
FIG. 14E is a perspective view of the Calendar Month Box, with remainder of the month sliders removed from the interior box storage area, displaying the month of May to illustrate the sliding action of the current month slider being inserted.

FIG. 14D is the front view of the Month Box 14, without storing remainder month sliders, displaying the month of May to illustrate the sliding action of the Current Month Slider 16 being inserted. FIG. 14E is a perspective view of the Month Box 14, without storing remainder month sliders, displaying the month of May to illustrate the sliding action of the Current Month Slider 16 being inserted.

Figure 14F:
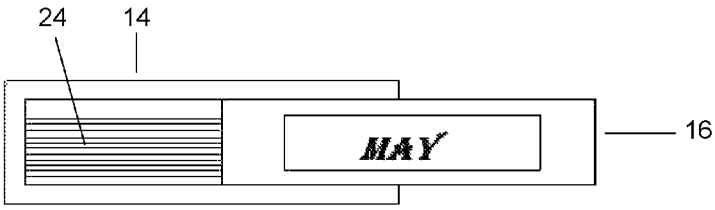
FIG. 14F is the front view of the Calendar Month Box, storing the remainder non-current month sliders, displaying the month of May to illustrate the sliding action of the current month slider being inserted.
Figure 14G:
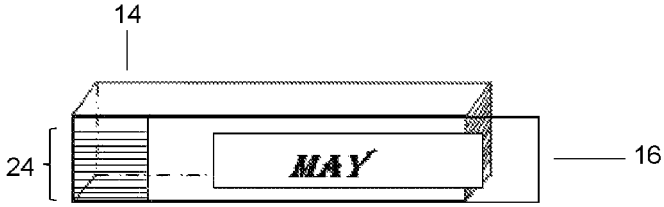
FIG. 14G is a perspective view of the Calendar Month Box, storing the remainder non-current month sliders, displaying the month of May to illustrate the sliding action of the current month slider being inserted.

FIG. 14F is the front view of the Month Box 14, storing the remaining Non-Current Month Sliders 24, displaying the month of May to illustrate the sliding action of the Current Month Slider 16 being inserted. FIG. 14G is a perspective view of the Month Box 14, storing the remainder Non-Current Months Sliders 24, in the hollow interior area of the month box, displaying the month of May to illustrate the sliding action of the Current Month Slider 16 being inserted.

Figure 15:
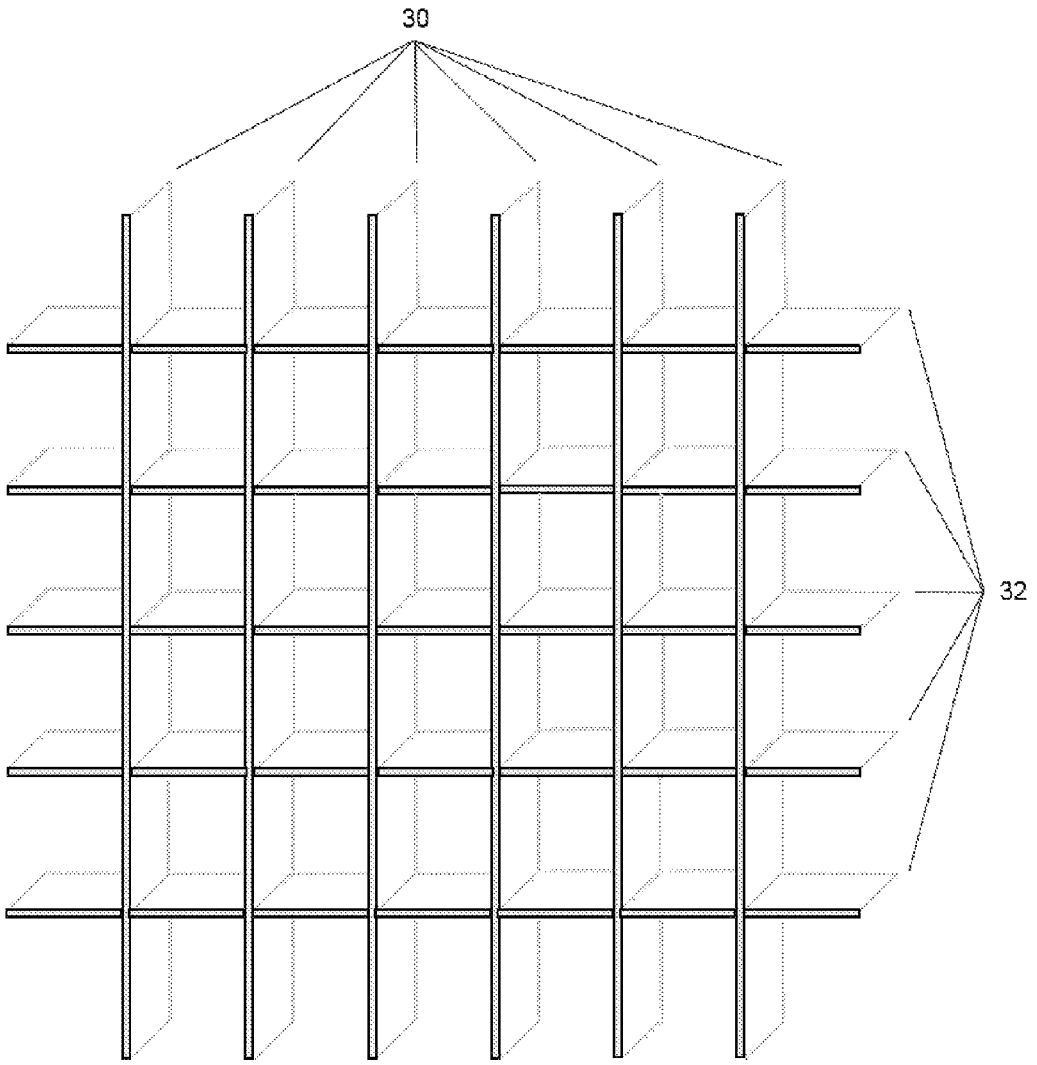
FIG. 15 is a perspective view of the Calendar's Vertical Partitions and Horizontal Partitions displaying the forty-two compartments assembled.

FIG. 15 is a perspective view of the Vertical Partitions 30 and Horizontal Partitions 32 displaying the forty-two compartments, configured as 6 rows and 7 columns, assembled.

Figure 16:
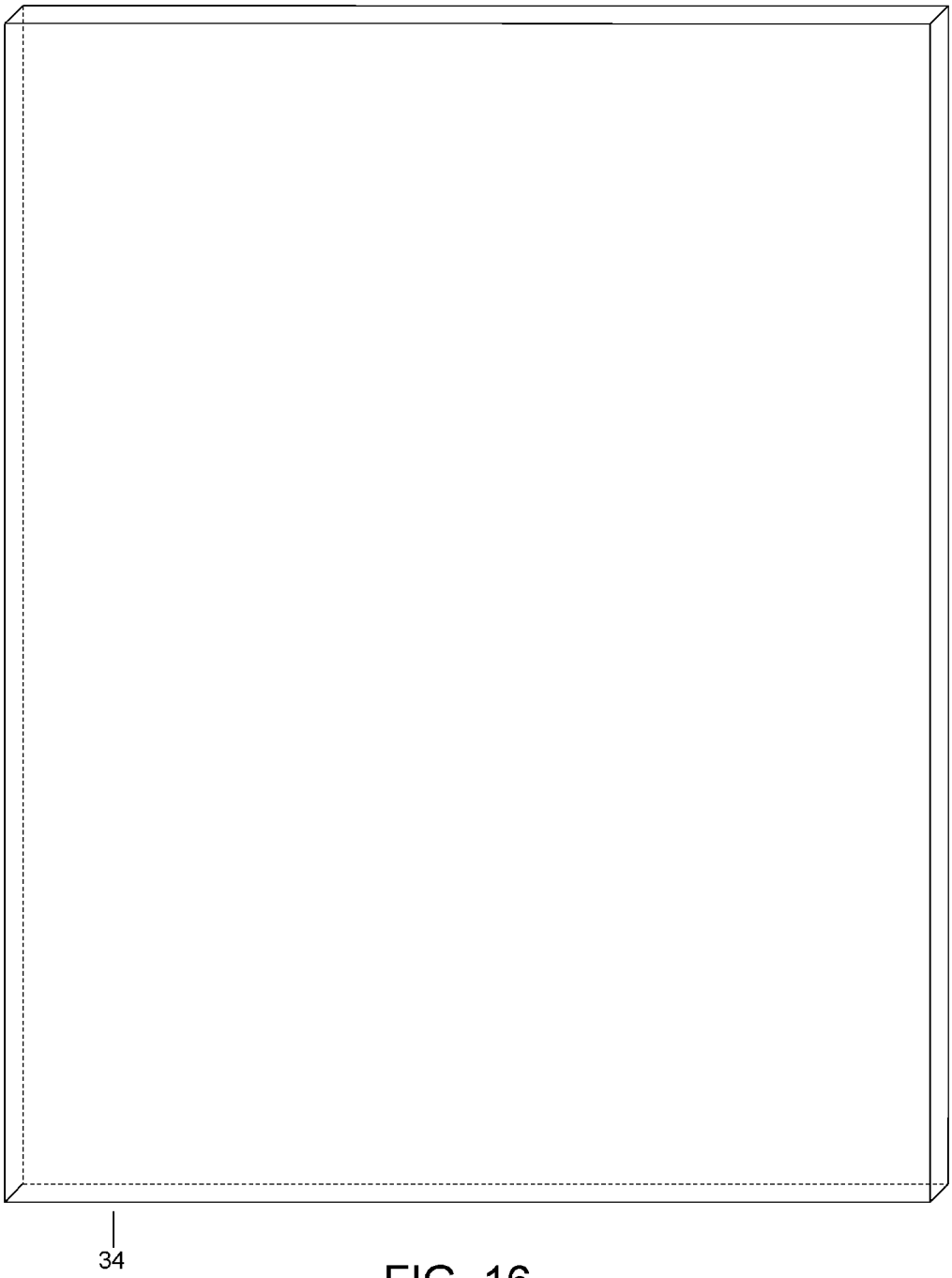
FIG. 16 is a perspective view of the Calendar's Backboard.
Figure 17:
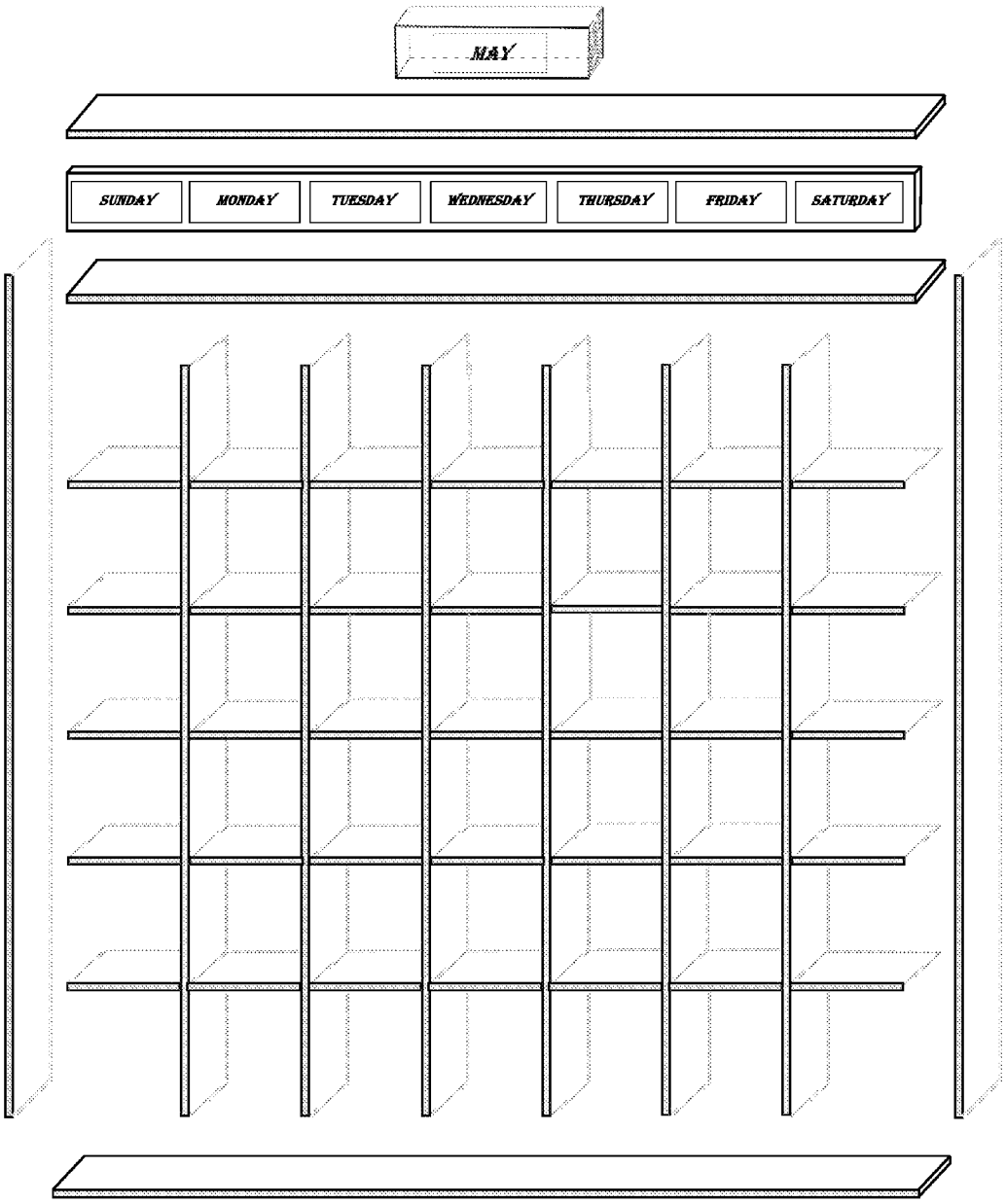
FIG. 17 is a perspective view of the overall assembly for the Customized Storage Calendar.

FIG. 16 is a perspective view of the calendar's Backboard 34 to which the calendar assembly shown in FIG. 17 is secured to.

FIG. 17 is a perspective view of the overall assembly for the Customized Storage Calendar. The Backside 34 is secured to the calendar assembly shown in FIG. 17, and the Day Boxes 10 are placed in the calendar.

When the Customized Storage Calendar is configured as a devotional calendar, the thirty-one day boxes are removed and opened for dessert chocolates to be placed in the boxes. The thirty-one day boxes are then closed and placed back in the devotional calendar. After dinner, the current day box is removed from the calendar and the devotional scripture on the top wall of the box is read. Then the current day box is opened for dessert chocolates to be consumed and/or shared. The current day box is placed back into the devotional calendar.

Although the description and drawings contain many specificities, these should not be construed as limiting the scope of the invention. The visible representation shown in the drawings and described above are for illustrative purposes, and are not intended to limit scope of the invention as defined in claims that follow. For example, joints can be used to secure the compartments to the calendar frame versus being glued. The illustrated Vertical Partitions 30 can have a tenon on the top end of the vertical partition and a mortise on the Horizontal Support Member 20 which can join to form a joint thus securing without the need for glue. Likewise, the illustrated Vertical Partitions 30 can have a tenon on the bottom end of the vertical partition and a mortise on the Bottom Wall 22 which can join a joint thus securing without the need for glue. Thus, the scope of the invention encompasses not only the disclosed illustrated representation of the invention, but also all equivalent ways of practicing or implementing the invention as defined in claims that follow.

What is claimed is:

1. A Customized Storage Calendar comprising:

thirty-one numbered day boxes made of durable, cuttable material having a front wall, back wall, side walls, a top wall and bottom wall that define a day box storage area; positive subject indicia displayed on the top wall and a day number displayed on the front wall;

a month box made of durable, cuttable material comprising a top wall, bottom wall, a back wall, and a left side wall, that define a hollow interior box storage area and a front slot;

twelve month sliders, wherein each slider displays a month of the year, wherein one of the month sliders is removable received in the front slot of the month box and a remainder of the month sliders are stored in the interior box storage area;

a calendar frame comprising a top wall, bottom wall, left wall, right wall, six vertical partitions, five horizontal partitions configured as six rows and seven columns, and backboard to define 42 compartments;

a horizontal support member mounted on top of the six vertical partitions;

a week face plate having seven days of the week displayed thereon, the week face plate is sandwiched between the top wall of the calendar frame and the horizontal support member, and the month box is removable mounted on top of the calendar frame top wall;

wherein the thirty-one numbered day boxes are removable mounted within the compartments and wherein each day box is adapted to receive and store a dessert therein.

* * * * *